US006181231B1

(12) United States Patent
Bartilson

(10) Patent No.: US 6,181,231 B1
(45) **Date of Patent: *Jan. 30, 2001**

(54) DIAMOND-BASED TRANSFORMERS AND POWER CONVERTORS

(75) Inventor: Bradley W. Bartilson, Houston, TX (US)

(73) Assignee: Silicon Graphics, Inc., Mountain View, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/055,554

(22) Filed: Apr. 6, 1998

(51) Int. Cl.[7] ..... H01F 5/00
(52) U.S. Cl. ..... 336/200; 336/223; 336/232
(58) Field of Search ..... 336/200, 219, 336/232, 223

(56) References Cited

U.S. PATENT DOCUMENTS

| | | | | |
|---|---|---|---|---|
| 4,123,736 | * | 10/1978 | Bougham | 336/120 |
| 4,342,143 | * | 8/1982 | Jennings | 336/200 |
| 4,665,357 | | 5/1987 | Herbert | 323/361 |
| 4,845,606 | | 7/1989 | Herbert | 363/24 |
| 4,897,916 | * | 2/1990 | Blackburn | 336/217 |
| 4,942,353 | | 7/1990 | Herbert et al. | 323/361 |
| 4,978,906 | | 12/1990 | Herbert et al. | 323/361 |
| 5,093,646 | | 3/1992 | Herbert | 336/225 |
| 5,126,714 | | 6/1992 | Johnson | 336/83 |
| 5,479,146 | | 12/1995 | Herbert | 336/61 |
| 5,481,238 | | 1/1996 | Carsten et al. | 336/214 |
| 5,555,494 | | 9/1996 | Morris | 363/17 |
| 5,598,327 | * | 1/1997 | Sommverville et al. | 336/200 |
| 5,773,870 | * | 7/1998 | Su et al. | 257/531 |
| 5,777,539 | * | 7/1998 | Folker et al. | 336/200 |
| 5,781,093 | * | 7/1998 | Grandmont et al. | 336/232 |
| 5,844,461 | * | 12/1998 | Faulk et al. | 336/206 |

OTHER PUBLICATIONS

"Introduction to Transformer", In: *Magnetic Circuits, Transformers, and Three–Phase Circuits,* 589–598, (No Date Given).

"Transformers", *Precision Incorporated,* Chapter 22, 581, (No Date Given).

* cited by examiner

*Primary Examiner*—Michael L. Gellner
*Assistant Examiner*—Anh Mai
(74) *Attorney, Agent, or Firm*—Schwegman, Landberg, Woessner & Kluth, P.A.

(57) ABSTRACT

Diamond is used as an electrically insulating substrate in multi-layer devices. In a transformer, the first electrical conductor forms a coil. The first electrical conductor is formed in a plurality of layers. Electrical carriers are formed on a layer to make an electrical path around a core of ferrous material. The second conductor forms a second coil of the transformer and also wraps around the core of ferrous material. Using diamond is advantageous in a transformer since the diamond is very effective at transferring heat from the core. The diamond also electrically insulates the various portions of the transformer. An electronic packaging concept includes mounting one or more electronic components to a substrate including a layer of diamond. The layer of diamond is sufficient to transfer heat from the one or more electronic components attached to the diamond substrate. The entire substrate can also be made of diamond. Diamond is unique in that it is a good electrical conductor as well as a good thermal conductor.

19 Claims, 3 Drawing Sheets

DIAMOND-BASED TRANSFORMERS AND POWER CONVERTORS

FIELD OF THE INVENTION

The present invention relates generally to a method and apparatus for transferring heat from electrical circuit devices. The present invention relates to the use of diamond in electrical circuit devices to provide electrical insulation as well as heat transfer from the electrical devices.

BACKGROUND OF THE INVENTION

Many electrical devices are constructed from a plurality of electrically conductive layers separated by one or more layers of electrical insulation material. For example, a capacitor is basically two metal plates separated by a layer of an electrically insulative material. In some instances, the electrically insulative material is air. In other instances, an actual electrically insulative material, such as Kapton or a similar material is used. Similarly, transformers include coils of wires that conduct electricity. A non-thermally conductive insulation material is placed around each wire in the coil to prevent individual wires in the coil from "shorting". The insulation layer prevents the flow of heat from the center of the transformer. This causes high core temperatures and reduced product life.

High temperatures can cause failure of an electrical component or reduced product life. Excessive operating temperatures can cause degradation of the insulation thereby enabling a short to develop between conductors previously separated by an insulative layer. As a result, there is always a need for an apparatus or material which can carry away heat, or cool, an electrical component and do it more efficiently. In the case of layered electrical devices such as transformers, inductors and capacitors, there is a need for a material that provides superior thermal transport and superior resistance to electrical current flow.

Smaller components are a constant goal of the electronics industry. Smaller components cost less and also result in smaller system packages. If a material and method that allows for more efficient dissipation of heat can be used, smaller amounts of that material need to be present to carry away the same amount of heat. Therefore, smaller components can be made. Electrical transformers can now be made in layers. The layers of the transformer are separated by an insulative material. If the insulative material is more effective at transferring heat, a thinner layer of insulative material can be used in forming the transformer. Thinner layers also result in lower core losses.

One way of building a multiple-device electronic component is to populate a common substrate with individual electrical components. In other words, discrete electrical components are attached to a substrate. Other electrical components, like capacitors or traditional transformers having coils wound about a core, mount directly to a substrate. The area of the substrate adjacent the electrical component may not be exposed to an ambient environment. The portion of the substrate next to the component may heat, causing the temperature to rise and possibly resulting in a failure. Thus, there is also a need for a material and method for making a substrate that efficiently removes heat from the individual components and delivers it to the chosen thermal "sink."

SUMMARY OF THE INVENTION

An electronic packaging concept includes mounting one or more electronic components to a substrate including a layer of diamond. The layer of diamond is in sufficient volume to transfer heat from the one or more electronic components attached to the diamond substrate. The entire substrate can also be made of diamond. Diamond is unique in that is a good electrical conductor as well as a good thermal conductor. As a result, the number of electrical components that can be mounted on such a substrate can be increased and the heat produced will be carried away more efficiently when compared to substrates made from other electrically insulative materials. Using such a substrate eliminates the need for added fins on some components and would allow for a much more densely packed set of components when compared to substrates made from other electrically insulative materials.

In addition to a diamond layer as a substrate, diamond can also be used in an electrical apparatus which can be constructed in multi-layer fashion. The layering includes alternate layers of patterned metallization (an electrical conductor) and diamond (a thermal conductor and electrical insulator). The apparatus can be a capacitor, an inductor, or a transformer. In a transformer, the patterned metallization for a transformer results in a first coil and a second coil. A first electrical conductor pattern forms the first coil and the second electrical conductor pattern forms the second coil. The first electrical conductor is formed in a plurality of layers. Metal patterns are formed on a layer to make an electrical path around a core of ferrous material. The second conductor forms a second coil of the transformer and also wraps around the core of ferrous material. Using diamond is advantageous in a transformer since the diamond is very effective at transferring heat from the core of the transformer. The diamond also electrically insulates the various portions of the transformer. Because of the great thermal conductive characteristics, smaller transformers can be built since less material is needed to effectively remove heat from the core of the transformer.

An appreciation of other aims and objectives of the present invention and a more complete and comprehensive understanding of this invention may be achieved by studying the following description of a preferred embodiment and by referring to the accompanying drawings.

BRIEF DESCRIPTION OF THE DRAWINGS

For a better understanding of the present invention, reference may be made to the accompanying drawings in which.

DESCRIPTION OF THE EMBODIMENT

Figure 1:
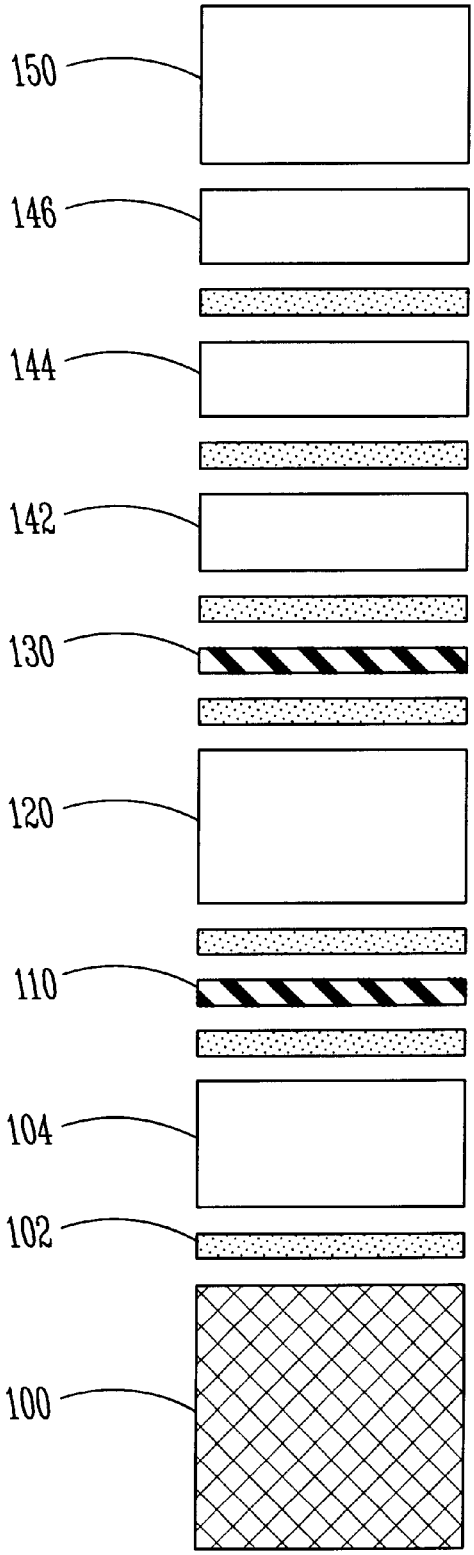
FIG. 1 is a view of the layers forming a prior art transformer.

In the following detailed description of the embodiment, reference is made to the accompanying drawings which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that structural, logical and electrical changes may be made without departing from the spirit and scope of the present invention. The following detailed description is, therefore, not to be taken in a limiting sense, and the scope of the present inventions is defined only by the appended claims.

Most materials that are good electrical insulators are also very good thermal insulators. Diamond is unique in that it is a good electrical insulator and yet is a poor thermal insulator. In other words, diamond is a good conductor of thermal energy while remaining a good electrical insulator. This is advantageous in that diamond can be used in certain applications as both a good electrical insulator and a good conductor of thermal energy. Synthetically-grown diamond has achieved thermal conductivities of greater than 1500 w/mk in substrate thicknesses up to 1 mm. The electrical resistivity exhibited by this diamond is of the order $10^{15}$ Ohm-cm. Several applications of diamond used in various electrical components as well as a substrate for carrying one or more discrete components will be discussed in the following paragraphs of the description of the preferred embodiments.

Transformers

Transformers are used to increase or decrease the voltage of alternating current. Several coils of wire are formed around a large magnetic core. Cores may be cylindrical, toroidal or of various geometries. One coil, called the primary, is connected to the input circuit, whose voltage is to be changed. The other coil, called the secondary, is connected to the output circuit, where the electricity with the changed (transformed) voltage is output.

As the alternating current in the input circuit travels through the primary coil, it sets up a magnetic field that changes in intensity and direction in response to the alternating current. The changing magnetic flux induces an alternating voltage in the secondary coil. The ratio of the number of turns in each coil determines the transformation ratio. For example, if there are twice as many turns in the primary as in the secondary, the output voltage will be half that of the input voltage. On the other hand, since energy cannot be created or destroyed, the output current will be twice as much as the input current.

In the past, the coils were formed by winding a first wire around the core and a second wire around the core. Since coil winding is a long and tedious process, transformers can now be made of layers of electrically conductive material and electrically insulative material. The laminated winding transformer is constructed in a layered fashion. This transformer includes layers of interconnected pattern-metallized diamond with a series of magnetic cores on "posts" made from the layers of the stack. The metallized patterns thus constitute windings around the cores. The cores are made from high-permeability magnetic material. The cylindrical cores are part of continuous, magnetic material plates for common flux and support. The plates are located at the top and bottom of the winding/lamination layers. When the top plate is assembled on top of the core sections protruding from the bottom plate they create a single core which provides high-permeability paths for magnetic flux.

Interposed between the top and bottom plates are at least one primary and at least one secondary coils. The primary and secondary coils have feed-through holes, vertically aligned with the feed-through holes in the top holes to allow the secondary terminals to protrude through, and tabs for connecting to the input circuit. The primary coil is made of a laminate clad with an electrical conductor. The current flows in the electrical conductor. The circuit which conducts the current around the many core sections is fabricated by etching a special pattern of insulative gaps into the electrical conductor. The gaps are necessary to prevent shorting but they must be quite narrow in order to minimize leakage of magnetic flux. If more than one primary layer is used the primary layers are connected to each other in series. Furthermore, they are connected so the path taken by the electrical current in one layer is opposite to that taken by the current in the previous primary layer in the series.

The printed circuit windings have holes to allow the core sections to protrude through. The circuit which conducts the current around the cores is fabricated by etching a special pattern of insulative gaps into the electrical conductor. The gaps are necessary to prevent shorting but they must be quite narrow in order to minimize leakage of magnetic flux. The output circuit is connected to the secondary at three points. These points are accessible through the feed-through holes which pierce the top and the primary. If more than one secondary is used, the patterns etched into their surfaces are rotated from each other by 90 degrees. A center-tapped transformer can be provided by connecting the secondary layers to each other at the center connection point.

The completed transformer is laminar in construction. In fact the primary and secondary coils can be fabricated by single- or multiple-layer printed circuit techniques. This makes then very inexpensive to produce and repeatably, precisely manufacturable. The completed transformer also has a low profile, a small volume and is very efficient, and transforms high-power currents with very low electrical and thermal resistance.

Now turning to FIG. 1, the layers of a prior-art-type laminar transformer are shown. The core 100 is surrounded by layer 102 of an electrical insulator commonly known as Kapton. Kapton is an electrical insulator as well as a thermal insulator. A layer of copper 104 is used as a heatsink to carry heat away from the core of the transformer. Copper is a good conductor of heat and electricity. Kapton then is used to bound a shield 110 between the copper heatsink layer 104 and a layer of a primary coil 120. Another shield 130, bound by Kapton, shields the primary coil 120 from a first layer 142 of the secondary coil 140. Kapton is used to insulate a second layer 144 of the secondary coil 140 from the first layer 142. Similarly, Kapton is used to insulate a third layer 146 of the secondary coil 140 from the second layer 144. A potting material 150, which is another thermal insulator, is then placed onto the resulting transformer.

Such a design of layers of metal (forming the coils) separated by electrical insulation results in thermal blockage of the transformer. The electrical insulation layers block the heat conductive path from the inside of the transformer to the outside of the transformer. Even with a copper layer serving as a heatsink, there can be thermal temperature differences of greater than 60 degrees Centigrade from inside to outside the transformer.

Figure 2:
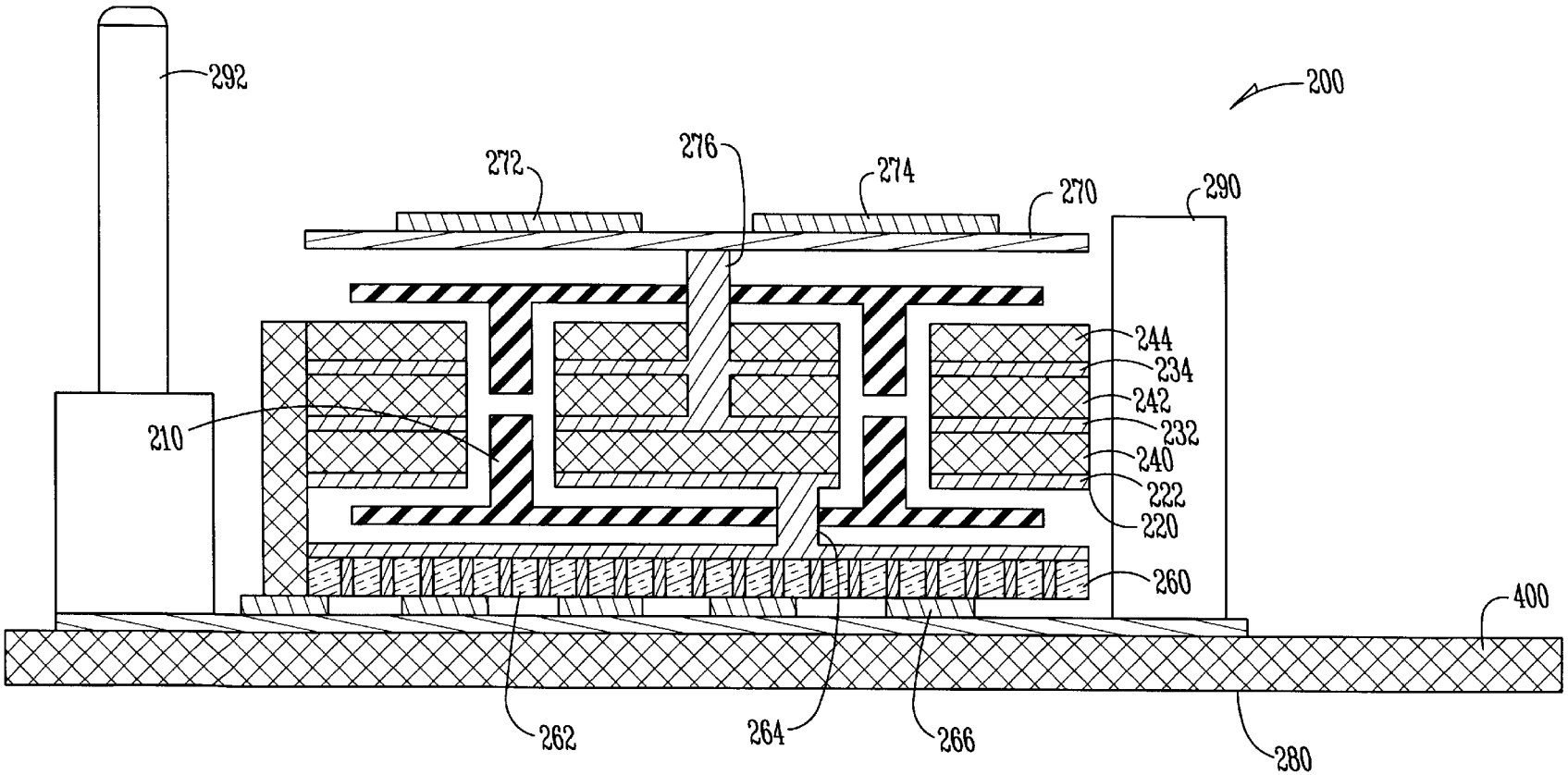
FIG. 2 is a cutaway side view of a transformer.

FIG. 2 shows a transformer 200. The transformer 200 includes a core 210, a primary winding 220, a secondary winding 230. The primary winding or coil 220 and the secondary winding or coil 230 are both formed by metalizing a conductive path on a diamond layer. The result is a lamination of metallized layers which form the primary winding 220 and the secondary winding 230, separated by a diamond layer which serves as an electrical insulator. As shown in FIG. 2, one metallized layer 222 forms the primary winding 220 and two metallized layers 232, 234 form the secondary winding 230. A diamond layer 240 separates metallized layers 222 and 232. A diamond layer 242 separates metallized layers 232 and 234. A diamond layer 244 separates layer 234 from the core 210.

The transformer 200 sits on a metallized substrate 260 with a multiplicity of through vias 262. The substrate 260 is electrically connected to the secondary core or winding 220 by a via 264. The substrate 260 is attached to a series of GaAs VFETs 266 which serve as switches. The GaAs VFET switches 266 provide synchronous rectification which allows for high efficiency over a large load range. The GaAs VFET's 266 also have a reduced die area and operate at higher operating frequencies so that a higher frequency transformer can be achieved. The GaAs VFET's 266 are electrically connected to an output bus 280. The output bus 280 is connected to an output inductor 290 and an output pin 292. The output bus 280 feeds the current to the output inductor 290 and the output pin 292.

A printed wire board 270 having a first control IC 272 and a second control IC 274 is attached to the primary winding 230 by a via 276. The control ICSs 272 and 274 sense output voltage and provide feedback to the input gate drive circuitry which drives the primary side of the transformer 200.

Figure 3:
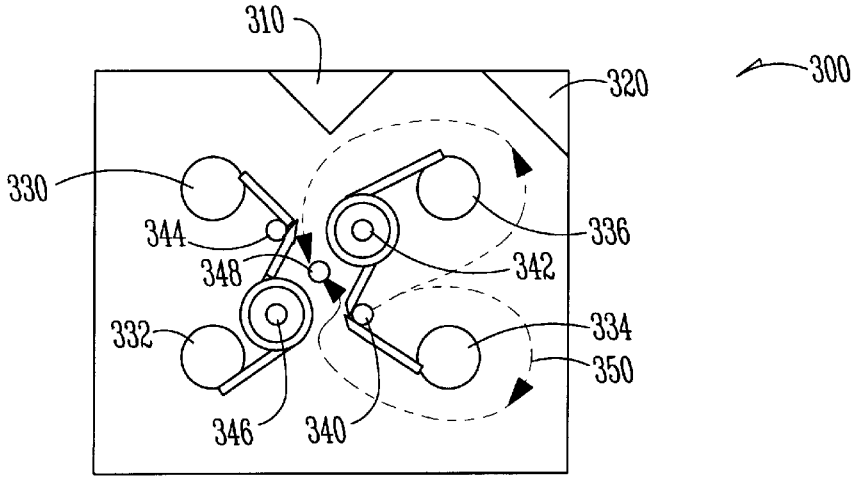
FIG. 3 is a top view of one layer of the transformer shown in FIG. 2.

The transformer 200 is actually assembled by laying down multiple layers of material. FIG. 3 shows one layer 300 of the multiple layers of the transformer 200. On the initial substrate, a layer of diamond is vapor-deposited on a mandrel. The layer of diamond is metallized. Metal is then removed, such as by etching away all the metal with the exception of the metal conductor, which is used to form a portion of a coil or winding. Once etched, another layer of diamond is vapor-deposited onto the metallized layer. The process is repeated until the layers are complete. Through-holes or vias are openings placed between the layers to connect various portions of a coil or to provide for output or input to the transformer 200. The pattern for each layer 300 is shown in FIG. 3. The pattern is rotated layer to layer, to impart pole phasing. The layer 300 includes a first connection pad 310 and a second connection pad 320. There are four magnetic core poles 330, 332, 334, and 336. There are also four secondary pins 340, 342, 344 and 346 which serve as connection points to the input for the transformer 200. A center tap pin 348 is also shown. The layer 300 as configured is a sub-assembly that can be fabricated into a primary or secondary coil portion through placement of the diamond insulator. In FIG. 3 the diamond insulator material is depicted by black lines and circles. To form one layer of a certain coil, secondary pins or connection points 342 and 346 are electrically isolated by placing an insulative ring around these connection points. The electrical path is formed by placing diamond electrical barriers 350, 352 and 354 between the input connection point, which in this case is secondary pin 340, and the center tap pin 348. The diamond barriers force an electrical path 350 around the poles 334 and 336. The current path 350 is input to pin 348 in this layer and is output to the pin 340 in this particular layer 300. The diamond barriers are switched to form different coil portions. Different pins 344, 342 and 346 are used as input pins on different layers of the transformer 200. Pin 344 is also a parallel path on this layer, feeding current to the same center top.

Diamond Substrate

Figure 4:
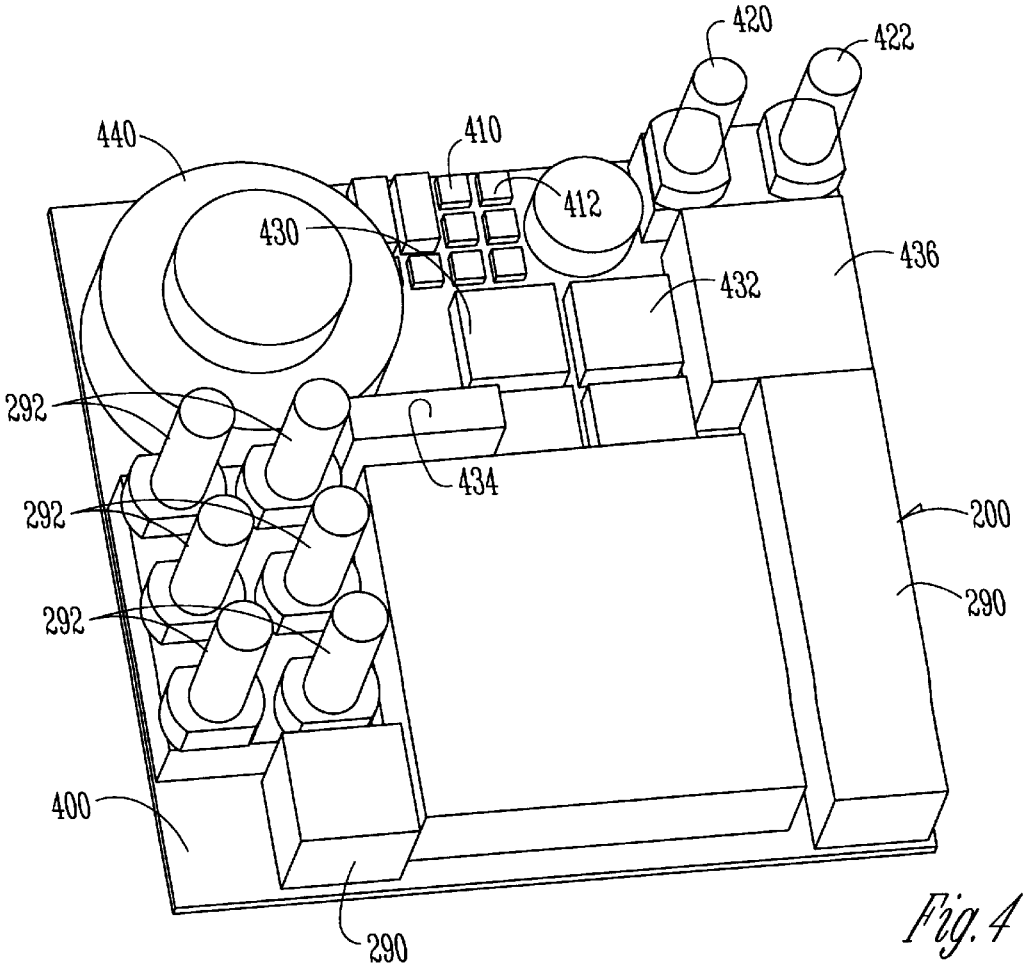
FIG. 4 is a top perspective view of a diamond substrate populated with electrical components.

Now turning to FIG. 4, the transformer and several other components are attached to a diamond substrate 400 to form a printed circuit board carrying the transformer. The diamond substrate 400, advantageously, conducts heat away from the individual components attached to the substrate 400. The diamond substrate includes one or more layers of diamond for thermally conducting the heat from the components. The diamond substrate is shown in cross section in FIG. 2. The transformer 200 is attached to the substrate 400. The GaAs VFET's 266 which connect the metallized substrate 260 to the output bus 280 are shown in phantom. Also attached to the diamond substrate 400 are the output pins 292, and the output inductor 290. Also attached to the diamond substrate 400 are drive caps and IC's 410, a gate drive transformer 412, input pins 420 and 422, input FETs 430 and 432, an input capacitor 434 and an input inductor 436. A resonant inductor 440 which serves as a current send transformer is also attached to the diamond substrate 400. The diamond substrate conducts heat away from all the components attached to the substrate 400.

The diamond substrate 400 is advantageous since it serves to remove heat from the individual components resident on the substrate 400. Since heat is efficiently removed, more components can be packed onto a substrate 400 having a smaller footprint or smaller length and width. This has application beyond a transformer and its various components shown in FIG. 4. More components can be more tightly spaced on any card for any application since the heat produced can be carried away more effectively by the substrate 400.

Diamond-based DC-DC Converter

A DC-DC converter uses a laminated winding transformer as described above. To construct a DC-DC converter device, the transformer is integrated into a multi-device package with devices to "chop" the primary-side DC voltage into an AC waveform as input to the transformer. The secondary output side requires a rectifier to transform the AC back into a new DC valve.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. An electrical transformer apparatus comprising:

a first layer having a first electrical coil;

a second layer having a second electrical coil; and a layer of diamond positioned between the first electrical coil and the second electrical coil, the layer of diamond electrically insulating the first electrical coil from the second electrical coil and conducting heat from the first electrical coil and the second electrical coil.

2. The apparatus of claim 1 where in the first coil is formed in a plurality of layers.

3. The apparatus of claim 2 further comprising a core formed in a plurality of layers of ferrous material, said first coil wrapping around the core of ferrous material.

4. The apparatus of claim 3 wherein the second coil is formed in a plurality of layers and wraps around the core of ferrous material.

5. An electronic package comprising:

a first electrical device;

a second electrical device; and a substrate including the first electrical device and the second electrical device, and a layer of diamond, the first electrical device positioned on one side of the layer of diamond and the second electrical device positioned on the other side of the layer of diamond, the layer of diamond serving to electrically insulate the first electrical device from the second electrical device and to thermally conduct heat from the first electrical device and the second electrical device.

6. The electronic package of claim 5 wherein a plurality of electrical components are attached to said substrate.

7. The electronic package of claim 5 wherein the layer of diamond within the substrate is sized to transfer the heat produced by the first electrical device and by the second electrical device from said substrate.

8. The electronic package of claim 5 wherein the first electrical device and the second electrical device and the layer of diamond form a portion of a transformer, said transformer formed in layers.

9. The electronic package of claim 5 wherein the substrate includes a plurality of layers of diamond.

10. The electronic package of claim 6 wherein said electrical component is a capacitor.

11. The electronic package of claim 6 wherein said electrical component is an inductor.

12. The apparatus of claim 1 further comprising:

first magnetic core passing through the first layer, the second layer, and the layer of diamond, wherein the first magnetic core forms a first magnetic path between the first electrical coil and the second electrical coil.

13. The apparatus of claim 12 further comprising:

a second magnetic core passing through the first layer, the second layer, and the layer of diamond, wherein the second magnetic core forms a second magnetic path between the first electrical coil and the second electrical coil, the first magnetic core forming an opposite magnetic polarity as the second magnetic core.

14. The apparatus of claim 12 further comprising:

a second magnetic core, third magnetic core and fourth magnetic core passing through the first layer, the second layer, and the layer of diamond, wherein the second magnetic core, the third magnetic core and the fourth magnetic core each form a magnetic path between the first electrical coil and the second electrical coil.

15. An electrical transformer apparatus comprising:

a first magnetic core;

a first coil layer having a first coil forming an electrically conducting path interacting with a magnetic field in the first magnetic core;

a second coil layer having a second coil forming an electrically conducting path interacting with the magnetic field in the first magnetic core; and a first layer of diamond positioned between the first coil and the second coil, the layer of diamond providing electrical insulation and heat conduction between the first electrical coil and the second electrical coil.

16. The apparatus of claim 15 further comprising:

a second magnetic core passing through the first coil layer, the second coil layer, and the first layer of diamond, wherein the second magnetic core forms a second magnetic path between the first electrical coil and the second electrical coil, the first magnetic core forming an opposite magnetic polarity as the second magnetic core.

17. The apparatus of claim 15 further comprising:

a second magnetic core, a third magnetic core and a fourth magnetic core passing through the first coil layer, the second coil layer, and the layer of diamond, wherein the second magnetic core, the third magnetic core and the fourth magnetic core each form a magnetic path between the first coil and the second coil.

18. The apparatus of claim 15 further comprising:

a third layer having a third coil forming an electrically conducting path interacting with a magnetic field in the first magnetic core; and a second layer of diamond positioned between the second coil and the third coil, the second layer of diamond providing electrical insulation and heat conduction between the second coil and the third coil.

19. The apparatus of claim 15 further comprising:

a third layer having a third coil fob an electrically conducting path interacting with a magnetic field in the first magnetic core;

a second layer of diamond positioned between the second coil and the third coil, the second layer of diamond providing electrical insulation and heat conduction between the second coil and the third coil; and a second magnetic core, a third magnetic core and a fourth magnetic core passing through the first layer, the second layer, and the layer of diamond, wherein the second magnetic core, the third magnetic core and the fourth magnetic core each form a magnetic path between the first coil, the second coil and the third coil.

* * * * *

UNITED STATES PATENT AND TRADEMARK OFFICE

CERTIFICATE OF CORRECTION

PATENT NO. : 6,181,231 B1
DATED : January 30, 2001
INVENTOR(S) : Bartilson

It is certified that error appears in the above-identified patent and that said Letters Patent is hereby corrected as shown below:

Column 4,
Line 23, delete "then" and insert -- them --, therefor.

Column 5,
Line 63, insert -- in sufficient volumne -- after "diamond".

Column 8,
Line 28, delete "fob an" and insert -- forming an --, therefor.

Signed and Sealed this

Twenty-fifth Day of December, 2001

*Attest:*

*Attesting Officer*

JAMES E. ROGAN
*Director of the United States Patent and Trademark Office*